US007497162B2

(12) United States Patent
Potzkai

(10) Patent No.: US 7,497,162 B2
(45) Date of Patent: Mar. 3, 2009

(54) METHOD FOR REDUCING REGISTER ERRORS ON A WEB OF MATERIAL MOVING THROUGH THE PRINTING NIP OF A MULTICOLOR WEB-FED ROTARY PRESS AND CORRESPONDING DEVICES

(75) Inventor: Thomas Potzkai, Gerolsheim (DE)

(73) Assignee: Koenig & Bauer Aktiengesellschaft, Würzburg (DE)

( * ) Notice: Subject to any disclaimer, the term of this patent is extended or adjusted under 35 U.S.C. 154(b) by 311 days.

(21) Appl. No.: 10/569,728

(22) PCT Filed: Sep. 1, 2004

(86) PCT No.: PCT/EP2004/051995

§ 371 (c)(1),
(2), (4) Date: Feb. 28, 2006

(87) PCT Pub. No.: WO2005/023690

PCT Pub. Date: Mar. 17, 2005

(65) Prior Publication Data

US 2006/0288895 A1 Dec. 28, 2006

(30) Foreign Application Priority Data

Sep. 1, 2003 (DE) ..... 103 40 569

(51) Int. Cl.
*B41F 13/02* (2006.01)
*B65H 23/188* (2006.01)

(52) U.S. Cl. ..... 101/219; 101/212; 101/116; 492/18

(58) Field of Classification Search ..... 101/219, 101/216, 212; 492/6, 7, 16, 18
See application file for complete search history.

(56) References Cited

U.S. PATENT DOCUMENTS

| | | | | |
|---|---|---|---|---|
| 3,389,450 | A | 6/1968 | Robertson | |
| 3,638,292 | A | 2/1972 | Gaghan | |
| 3,838,480 | A | 10/1974 | Depuy | |
| 3,880,076 | A * | 4/1975 | Black et al. | 101/115 |
| 4,404,906 | A | 9/1983 | Curran | |
| 4,438,695 | A | 3/1984 | Maier et al. | |
| 4,455,727 | A | 6/1984 | Tschirner | |
| 4,856,155 | A | 8/1989 | Niskanen et al. | |

(Continued)

FOREIGN PATENT DOCUMENTS

| | | |
|---|---|---|
| DE | 1 264 378 | 10/1955 |

(Continued)

*Primary Examiner*—Anthony H Nguyen
*Assistant Examiner*—Leo T Hinze
(74) *Attorney, Agent, or Firm*—Jones, Tullar & Cooper, PC

(57) ABSTRACT

The invention relates to a method for reducing register errors on a web of material (04) moving through the printing nip of a multicolor web-fed rotary press, comprising the following steps: providing a portion between an area of the web of material (04) located between the two lateral edges of the web of material (04) and areas in the vicinity of the lateral edges of the web of material with a deformation relative each other in a direction perpendicular to the plane of rotation of the web of material (04) subject to a register error occurring in the direction of rotation of the web of material (04).

21 Claims, 9 Drawing Sheets

U.S. PATENT DOCUMENTS

| | | | | |
|---|---|---|---|---|
| 4,905,598 | A | 3/1990 | Thomas et al. | |
| 4,913,051 | A | 4/1990 | Molinatto | |
| 5,419,242 | A | 5/1995 | van Haag | |
| 5,553,542 | A | 9/1996 | Jackson et al. | |
| 5,813,960 | A | 9/1998 | Schnyder | |
| 6,105,498 | A | 8/2000 | Vrotacoe et al. | |
| 6,283,027 | B1 | 9/2001 | Vrotacoe et al. | |
| 6,524,227 | B1 * | 2/2003 | Isometsa et al. | 492/7 |
| 6,550,384 | B1 | 4/2003 | Langsch | |
| 6,584,900 | B2 | 7/2003 | De Vroome | |
| 6,758,139 | B2 | 7/2004 | Knoll | |
| 6,786,151 | B2 | 9/2004 | Stiel | |
| 7,255,041 | B2 | 8/2007 | Riedel | |
| 2003/0010150 | A1 | 1/2003 | Glockner et al. | |
| 2005/0056171 | A1 * | 3/2005 | Hoffmann et al. | 101/217 |
| 2006/0183613 | A1 * | 8/2006 | Niemeyer | 492/7 |

FOREIGN PATENT DOCUMENTS

| | | | |
|---|---|---|---|
| DE | 30 33 230 | A1 | 3/1982 |
| DE | 30 33 230 | C2 | 3/1982 |
| DE | 86 10 958.8 | | 8/1986 |
| DE | G 88 08 352.7 | | 9/1988 |
| DE | 83 04 988.6 | | 12/1991 |
| DE | 196 54 199 | | 7/1998 |
| DE | 199 60 649 | A1 | 6/2001 |
| DE | 199 63 945 | | 7/2001 |
| DE | 100 23 205 | | 11/2001 |
| DE | 203 09 301 | U1 | 10/2003 |
| EP | 0 331 870 | | 9/1989 |
| EP | 0 659 585 | A1 | 10/1994 |
| EP | 0 741 253 | | 11/1996 |
| GB | 731833 | | 6/1955 |
| GB | 1059559 | | 2/1967 |
| WO | WO 99/40005 | | 2/1999 |

* cited by examiner

METHOD FOR REDUCING REGISTER ERRORS ON A WEB OF MATERIAL MOVING THROUGH THE PRINTING NIP OF A MULTICOLOR WEB-FED ROTARY PRESS AND CORRESPONDING DEVICES

CROSS-REFERENCE TO RELATED APPLICATIONS

This patent application is the U.S. national phase, under 35 USC 371, of PCT/EP2004/051995, filed Sep. 1, 2004; published as WO 2005/023690 A1 on Mar. 17, 2005, and claiming priority to DE 103 40 569.0, filed Sep. 1, 2003, the disclosures of which are expressly incorporated herein by reference.

FIELD OF THE INVENTION

The present invention is directed to methods for the reduction of register errors on a web of material passing through a printing nip in a multi-color web-fed rotary printing press, and to devices for accomplishing that reduction in register errors. A deformation is established between an area of the web intermediate its edges, and areas in the vicinity of the edges of the web.

BACKGROUND OF THE INVENTION

Register errors can occur when printing, in a positionally correct manner, from several serially-positioned printing formes, and particularly in the course of color printing. In this case, the web of material passes successively through several printing groups, in which groups the web is imprinted, respectively, in several colors. If these colors are not imprinted exactly on top of, or one after each other in the desired way, because of such variables as a varying module of elasticity of the web of material, a varying tension profile of the web of material, because of climatic influences or because of production tolerances of the printing forme cylinders, this inaccuracy is called register error.

The extent of a register error can be a function of its position in the lateral direction of the web. If this function is imagined as being developed as a Taylor series, it can be seen that, in general, the register error is composed of a term of zero order, which is independent of the lateral position, a term of the first order, which is proportional to the position in the lateral direction, and terms of higher orders. The term of zero order, such as, for example a register error, over the entire width of the web of material, in the transport direction of the web of material, can be corrected, in particular, by a matching of the relative phase positions of the printing cylinders.

DE 199 60 649 A1 describes a device for correcting the lateral position of a web downstream of a dryer. A correction of the color register of the web is not provided by this device.

FIG. 1 of DE 86 10 958 U1 shows a curved lateral extension roller.

DE 83 04 988 U1 discloses a lateral edge control device for a screen printing machine. This device operates in connection with a pivotable roller.

U.S. Pat. No. 4,404,906 A shows a device for controlling the fan-out of a web by the use of a curved roller.

U.S. Pat. No. 6,550,384 B1 describes a device for correcting a width of a web of material. Adjustable deformation elements are looped by the web of material.

U.S. Pat. No. 5,553,542 A discloses a system for the regulation of the width of a web of material by the use of sensors and deformation units.

A rubber blanket with a varied profile for reducing the formation of creases is known from EP 0 659 585 A1.

SUMMARY OF THE INVENTION

The object of the present invention is directed to providing methods for accomplishing the reduction of register errors on a web of material, as the web is passing through a printing nip in a multi-color web-fed rotary printing press, and to corresponding devices.

In accordance with the present invention, this object is attained by establishing a deformation of a web in an area that is intermediate the lateral edges of the web, and areas which are adjacent to those lateral areas of the web, in a direction of travel of the web. The deformation is varied as a function of the register error in the web. A bendable roller, around which the web of material loops can have its curvature varied as a function of the register error. The bendable roller is situated at an inlet side of a printing group and is provided with at least one actuating element for setting its curvature.

Register errors, in the running direction of a web of material, are reduced by utilization of the present invention.

The advantages to be realized by the use of the present invention consist, in particular, in that it is possible, by the use of the present method, to reduce the second or higher orders of register errors, such as, for example a register error which occurs relative to the two sides of the web of material, and in particular, in the center of the web of material, which reduction in register errors is not possible with the known methods.

Moreover, it is possible, by the use of this invention, to control the register error over the entire width of the web as an S-line, so that on one side of the web, the register can be advanced in the direction of running, that register can remain in the zero position in the web center, such as, for example, at a seating location, and can be retarded opposite the direction of running on the other side of the press. This function can also be performed in the other direction transversely across the web.

The present invention can be configured to be considerably more simple, in comparison with the known methods. In particular, in comparison with the prior methods in which the module of elasticity of the web of material is affected, the method in accordance with the present invention can be controlled considerably more exactly. Register errors can accordingly be reduced more definitely and rapidly.

Advantageously, a zero order term of the register error is additionally reduced, in a known manner, by matching the relative phase position of the printing gap. A first order term of the register error, such as a register error which occurs on one side of the web of material, relative to the other side of the web of material, is reduced, in a generally known manner, by pivoting the roller, so that a shaft of the roller forms an angle with the printing gap.

It is possible, in this case, to detect the register error in the course of displacement, and the curvature of the roller can be adjusted while the web of material is running. Time is saved with this procedure, since the switch-off of the web of material and the later start-up of the web of material, such as is customary, for example, with width-adjusting rollers, which are curved when the press is stopped and which are pushed into a path of the web of material, is, as a rule, very time-consuming.

Customarily, the register error is detected on opposite edge areas of the imprinted web of material. This register error is compensated for by displacing, or by pivoting, the roller which is located upstream of the printing gap. In order to detect uncompensated terms of second or higher order of the register error, the register error should moreover also be measured in a center section of the web.

In a particularly preferred manner in accordance with the present invention, a marker is imprinted on the web of material in order to be able to detect the register error more easily.

A web-processing arrangement is suitable for executing the method of the present invention, which has a printing gap, through which a running web of material to be processed passes during the printing operation. A roller, which is arranged at the inlet side of the printing gap, can be curved. The web of material is at least partially looped around this roller during the operation of the device. At least one actuating member for use in setting a curvature of the bendable roller is provided. At least one sensor, for use in detecting a registration error on the web of material, is arranged at the outlet side of the gap or at the inlet of a following printing gap. An evaluation unit, that is connected with the sensor, is also connected with the actuating member for causing a change in the curvature of the bendable roller as a function of the detected register error and is used to reduce the register error by the use of this.

The bendable roller preferably is comprised of a shaft and a shell, and wherein the shell can be rotated around the shaft. In this case the shell can be supported, for example in the center of the shell by the shaft and on its ends, by a frame. The actuating member can be supported, on the one side, on the frame and can engage the shaft at the other side. It is also possible to displace the ends of the shell, relative to the shaft by the use of an actuating member, so that the center area of the shell remains approximately stationary and the ends of the shell are moved. In all cases the actuating member causes the bending of the shaft and of the shell, with respect to each other, so that, when viewed from the outside, the shell takes on a curved shape.

Advantageously the bendable roller can be seated, on two sides, in a frame, and wherein one end of the roller can be adjusted independently of the other. For example, this can be achieved wherein the bendable roller is seated, on at least one side, in an eccentric bearing positioned in the frame. Such seating of the bendable roller makes possible a simplified pivoting of the bendable roller, for reducing first order terms of the register errors, in such a way that a shaft of the roller forms an angle with the printing gap.

In a particularly preferred embodiment of the present invention, a deflection roller is provided, which deflection roller is arranged upstream of the bendable roller in respect to a running direction of the web of material, and which can be seated in different positions in the frame for use in adjusting the looping of the web of material around the bendable roller. This is of advantage, in particular, in connection with a bendable roller that is comprised of a shaft and of a rotatable shell, because such rollers are distinguished by an increased internal bearing friction. By setting a looping by the use of the deflection roller, and with this by accomplishing a force introduction into the bendable roller, it is possible to take care of this increased bearing friction. This moreover makes the device more flexible with regard to different paper types, for which a respectively ideal loop angle of the bendable roller can be set.

Preferably, the sensor is arranged in the center area of the web of material in order to detect register errors occurring there. In connection with this, at least one additional sensor, for use in detecting register errors, is provided in an edge area of the web of material in an especially preferred manner in accordance with the present invention.

As previously mentioned above, it is particularly preferred for the web-processing device to be a rotary rotogravure printing press.

BRIEF DESCRIPTION OF THE DRAWINGS

Preferred embodiments of the present invention are represented in the drawings and will be described in greater detail in what follows.

Shown are in.

DESCRIPTION OF THE PREFERRED EMBODIMENTS

Figure 1:
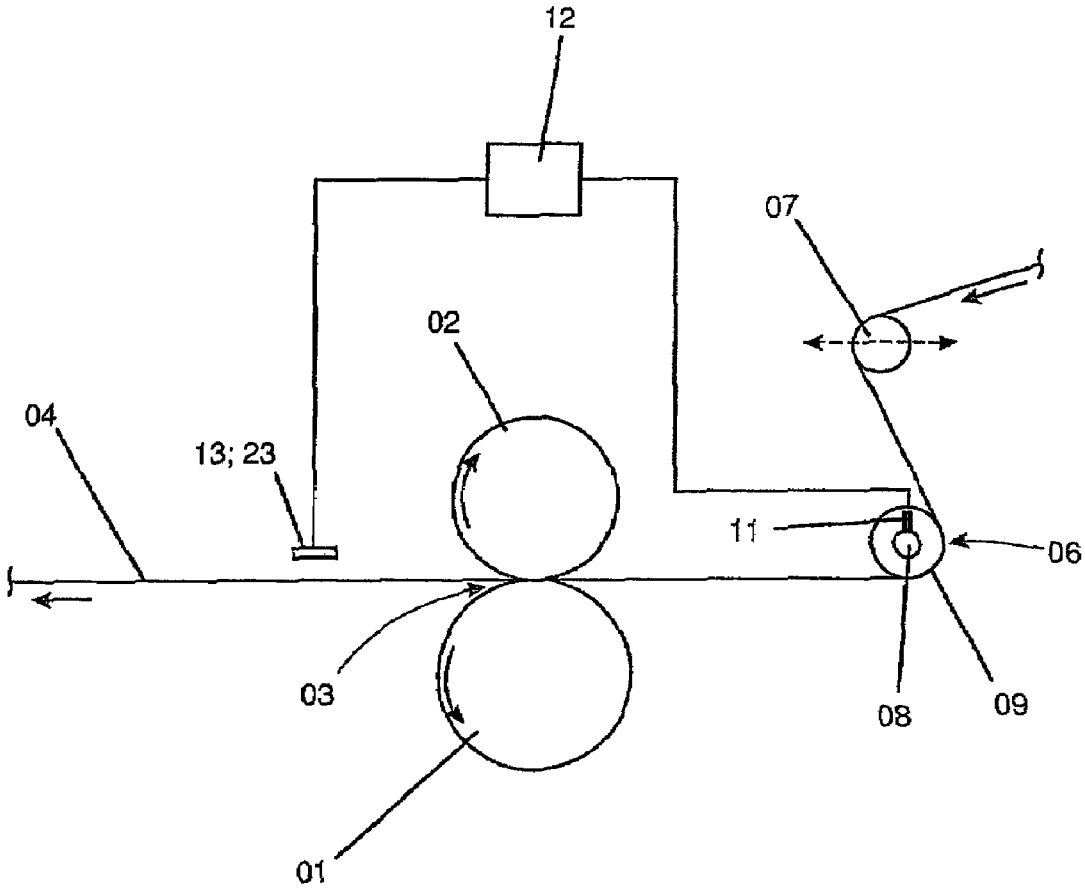
FIG. 1, a schematic side elevation view of a printing group of a rotary rotogravure printing press, in FIG. 2, a simplified cross sectional view through a first preferred embodiment of a bendable roller in accordance with the present invention, in FIG. 3, a schematic side view of a bearing of the bendable roller shown in FIG. 2, in FIG. 4, a top plan view of a portion of the rotary rotogravure printing press of FIG. 1, with a bendable roller which is pivoted obliquely in respect to the web of material, in FIG. 5, a side elevation view of a portion of the rotary rotogravure printing press from FIG. 1 with a slightly curved bendable roller, in FIG. 6, a side elevation view of a portion of the rotary rotogravure printing press from FIG. 1 with a greatly curved bendable roller, in FIG. 7, a simplified cross sectional view through a second preferred embodiment of a bendable roller in accordance with the present invention, in FIG. 8, depictions of the effects of different curvatures of the bendable roller on a web of material having image elements, in FIG. 9, depictions of the effects of different positions of various areas of the bendable roller on a web of material having image elements, and in FIG. 10, a schematic representation of devices for setting the register by the use of several deformation elements.
Figure 5:
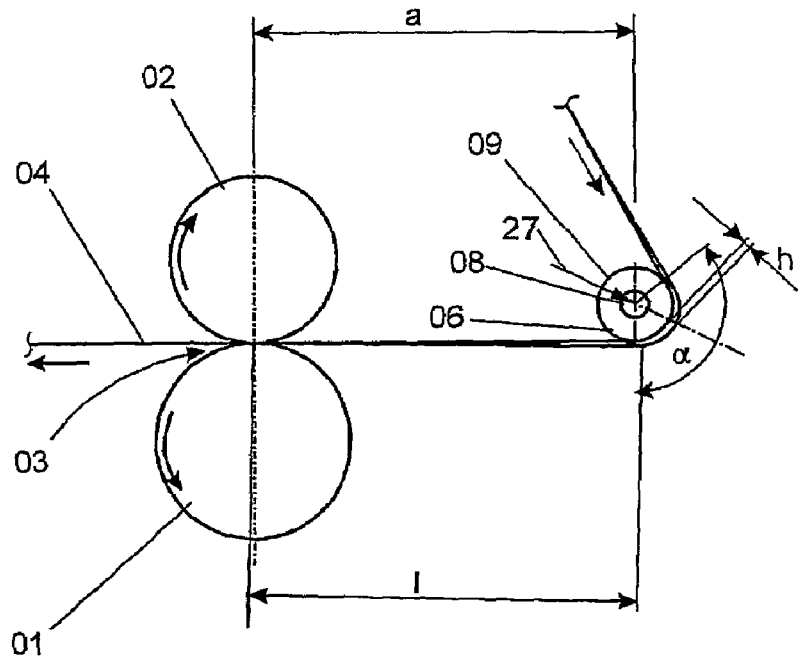
Figure 6:
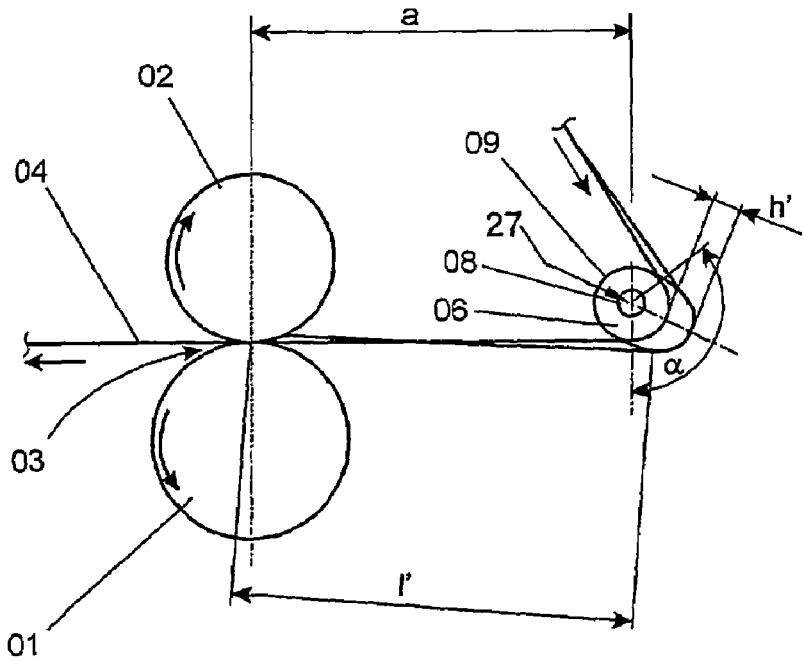

A printing group of a rotary rotogravure printing press is shown schematically, in a side elevation view in FIG. 1. In this printing group, a generally known forme cylinder 01, as well as a generally known counter-pressure cylinder 02, are seated in a frame, which is not specifically represented, and have been placed against each other in such a way that they form a printing gap 03. A running paper web 04 is conducted through the printing gap 03 as the web 04 of material. Arrows indicate the running direction of the paper web 04, as well as the directions of rotation of the forme cylinder 01 and of the cooperating counter-pressure cylinder 02. A bendable roller 06, such as, for example, a web guidance roller, and which roller 06 is not transferring ink, is arranged on the inlet side of the printing group ahead of the printing gap 03, which roller 06 is also referred to as a deformable roller 06. The paper web 04 loops, at least partially, around the roller 06 at a loop angle $\alpha$, as seen in FIGS. 5 and 6. A deflection roller 07 is seated in the frame upstream, with respect to the running direction of the paper web 04, of the deformable or bendable roller 06. The deflection roller 07 can be displaced into different positions in the frame, which displacement is indicated by a two-headed arrow that is shown in dashed lines in FIG. 1. The looping of the web 04 around the roller 06 changes, as a function of the position of the deflection roller 07. The deformable roller 06 comprises a shaft 08 seated in the frame, as well as a shell 09 which is seated so it is rotatable around the shaft 08, as may be seen in FIG. 2. In the embodiment of the roller 06 shown in FIG. 2, an actuating member 11, which is connected with an evaluation unit 12 and which is controlled by it, acts on each end section of the shaft 08. It is also possible to have an actuating member 11 act on each end section of the shell 09. The actuating members 11 can be operated electrically, pneumatically or hydraulically, for example. It is also possible to provide only one actuating member 11, which may be located on only one side of the roller 06. The evaluating unit 12 can be a control circuit or a micro-computer. Furthermore, a plurality of sensors 13, 23, as depicted in FIG. 1, are connected with the evaluation unit 12, which sensors 13, 23 are arranged on the outlet side of the printing gap 03 and are oriented toward both edges, as shown by sensors 23, FIG. 4, as well as toward a center section, as shown by sensor 13, of the paper web 04.

Figure 2:
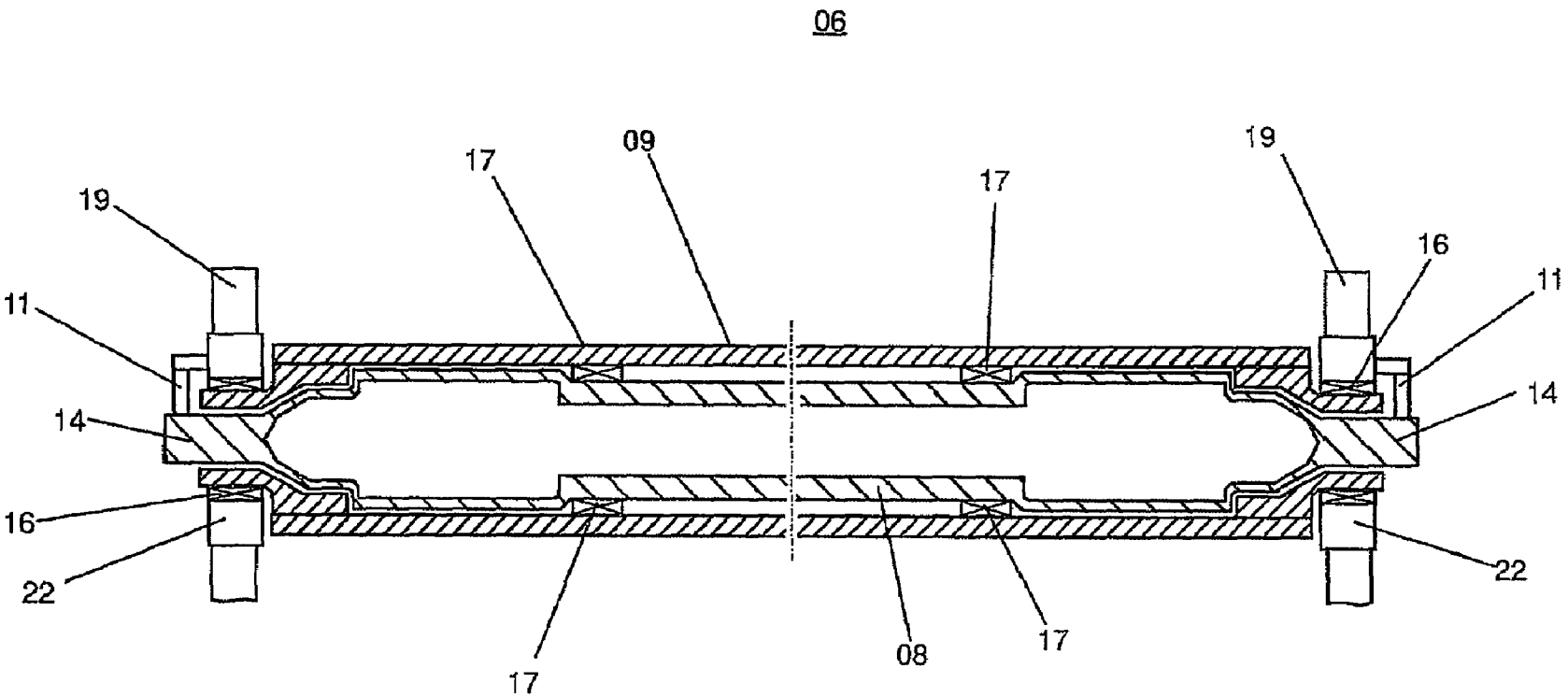
Figure 3:
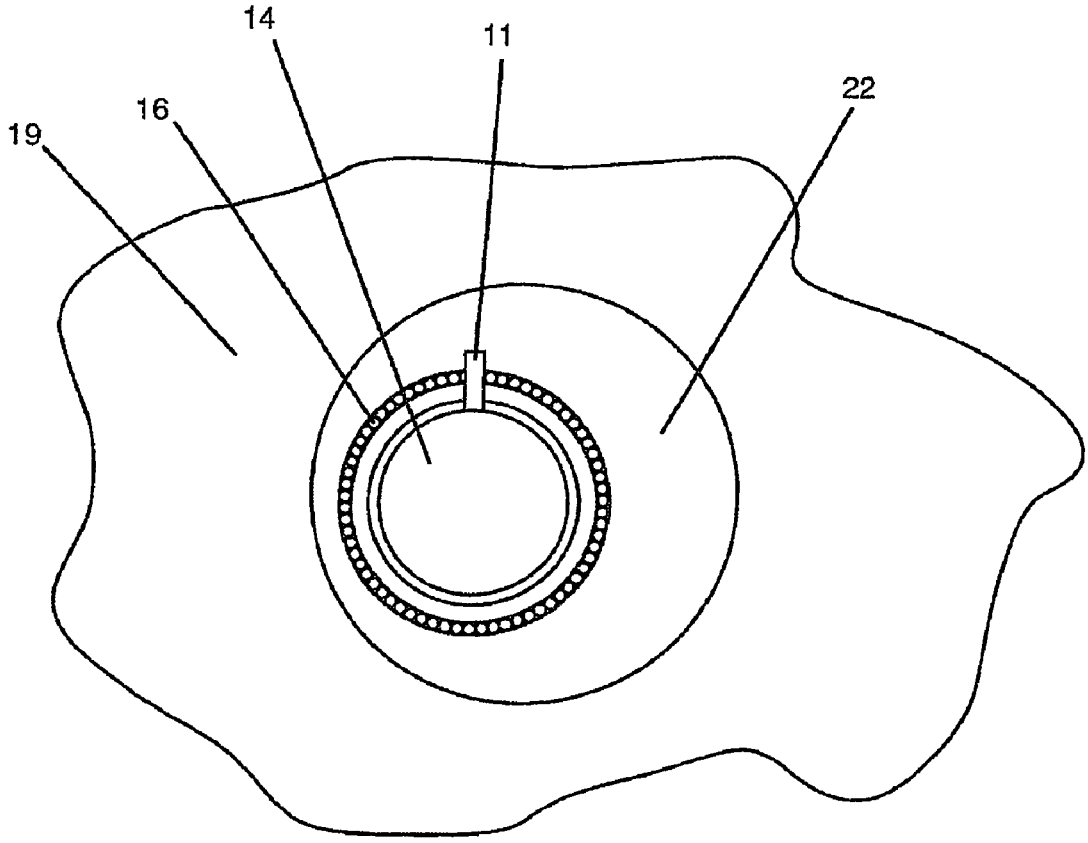

The bendable or deformable roller 06 from FIG. 1, which is seated in the frame 19, as shown in FIG. 2, is shown in longitudinal cross-section in FIG. 2, while FIG. 3 represents the seating of the roller 06 in the frame 19 from a lateral point of view. As can be seen in FIG. 2, the roller shell 09 is a hollow-cylindrical shell 09, which is rotatable around a shaft 08. The shell 09 is supported in its center area by one or by several bearings 17, such as, for example, rolling bearings 17, which have been inserted between it and the shaft 08. The shaft 08 comprises two opposite end sections 14, which are extended through the shell 09. The shell 19 is rotatably held at both ends by the use of bearings 16, such as, for example, rolling bearings 16, in respective eccentric bushings or bearings 22. Both eccentric bushings 22 can be rotated or pivoted by the evaluation unit 12 with the aid of a rotary actuator, which is not specifically represented. On one of its ends, each actuating member 11 acts on one of the end sections 14, and on the other of its ends, each activating member engages the frame 19 via the respective eccentric bearing 22.

During the operation of the rotary rotogravure printing press, the paper web 04 passes through the printing group along the path indicated in FIG. 1. To overcome interior bearing friction of the roller 06, as a result of the rotation of the shell 09 around the shaft 08, the deflection roller 07 is seated on the frame 19 in such a position that the looping of the bendable or deformable roller 06 by the paper web 04 permits a sufficient force to flow into the roller 06 for overcoming the bearing friction. The paper web 04 is imprinted by the forme cylinder 01 in the course of its passing through the printing gap 03. In the printing process, additional markings, such as so-called miniature point markers or register markers, are imprinted on the paper web 04. Image elements of the actual printed image can also be used in place of these additional register markers. Register markers are understood to include additional register markers, as well as existing image elements of the actual printed image, such as, for example, portions of the individual color separation of the printed image. These register marks and/or image elements are detected by the sensors 13, 23. It is also possible for one sensor 13, 23 to detect several register markers or several image elements. An occurring register error can be detected particularly easily and can be measured by the sensors 13, 23 by the use of these register markers. The results of this detection by sensors 13, 23 is passed on to the evaluation unit 12 from the sensors 13, 23. Depending on the size of the register error, the evaluation unit 12 will then issue an actuating signal to the actuating members 11, as well as to the rotary actuators of the eccentric bearings 22.

Figure 4:
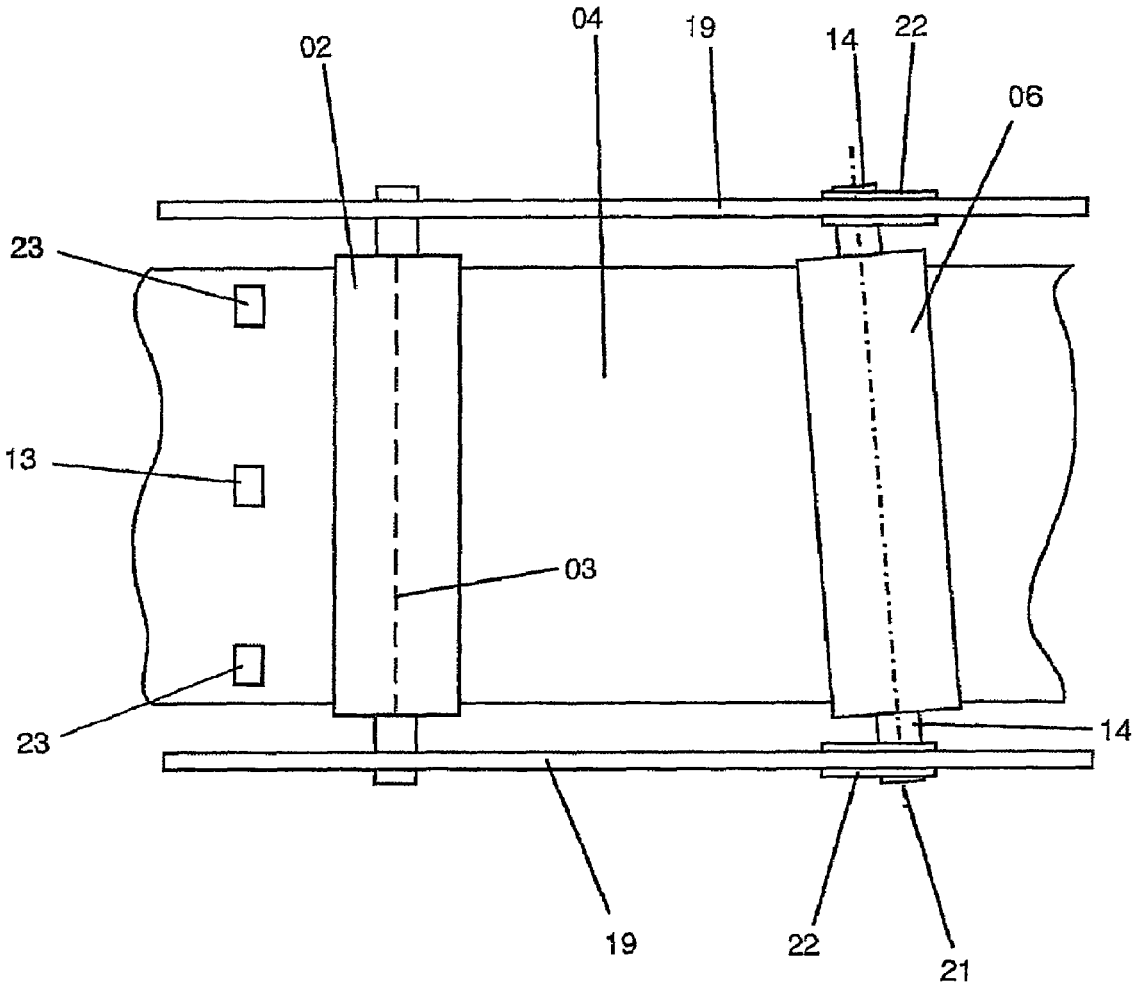

FIG. 4 represents a top plan view on the counter-pressure cylinder 02 and the roller 06, with there being depicted a pivoting or a shifting, at a differently large degree, at the two ends of the roller 06 which are seated in the frame 19. FIG. 4 also shows the paper web 04, which is guided through the printing gap 03, that is hidden by the counter-pressure cylinder 02, and which is therefore shown in dashed lines and loops around the roller 06 from below in the perspective view represented. On the outlet side of the hidden printing gap 03, a sensor 13 is oriented toward a center area of the paper web 04 in order to detect a register error occurring in this area. Moreover, further sensors 23 are arranged in the edge areas of the paper web 04. All of these sensors 13, 23 are connected with the evaluation unit 12, which is not represented in FIG. 4 but which is shown in FIG. 1.

Figure 9:
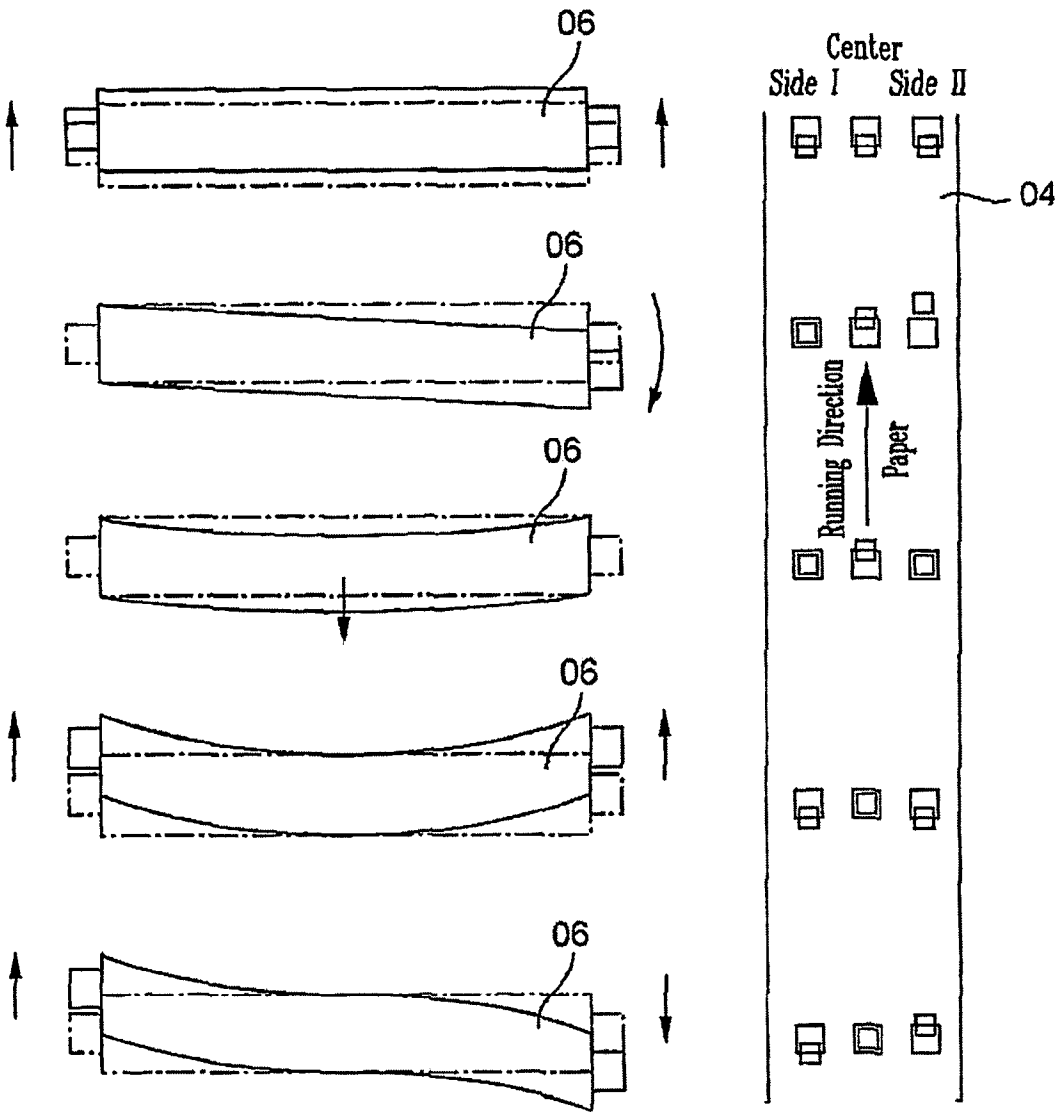

If the actuating signals, which are transmitted to the two rotary actuators of the eccentric bushings 22 at the ends of shaft 08 are the same, the result is an initial pivoting at the two end sections 14 of the shaft of roller 06 by identical amounts, wherein both eccentric bushings or bearings 22 are pivoted by the same amount in the same direction in order to reduce a zero order term of the register error, as depicted in FIG. 9. Differences in the actuating signals transmitted to the two rotary actuators for the eccentrics 22 result in pivoting of different amounts and directions at the two end sections 14 of the roller 06, as represented in FIG. 4, so that a shaft 21 or axis of rotation of the roller 06 and the printing gap 03 form an angle and make possible a compensation of the first order register error, which first order register error is mainly detected in the edge areas of the paper web 04 by the sensors 23, as depicted in FIG. 9. The roller 06 is thus skewed with respect to the printing gap 03.

The second order terms of the register error are detected, in particular, by the sensor 13 and are reduced by accomplishing a bending of the roller 06. To bend the roller 06, the actuating members 11 press on the extended end sections 14 of the shaft 08 with a force, and in the process exert a force on the shaft 08. The force exerted on shaft 08 is transmitted, via the rolling bearings 17, to the shell 09, which is bent as a result. The rolling bearings 17 assure that the shell 09 remains easily rotatable in spite of the considerable pressure and deformation forces exerted by the actuating members 11. Bearings 17 are preferably configured as cylinder rolling bearings 17 in order to prevent the tilting of the shell 09 at the shaft 08, which tilting could reduce the rotatability. As a result of the bending of the roller 06, points which are located in a center area of the paper web 04 have to travel longer paths from the roller 06 to the printing gap 03 than do points which are located in the edge areas of the paper web 04. This is made clear in FIGS. 5 and 6.

As seen in FIGS. 5 and 6 the printing gap 03, which is formed by the forme cylinder 01 and the counter-pressure cylinder 02, the roller 06 and the paper web 04, which paper web 04 is conducted through the printing gap 03 and which is looped around the roller 06, are represented for different curvatures or bending of the roller 06. The bendable roller 06 is arranged at a distance "a" from the printing gap 03. The roller 06 is shown less bent in FIG. 5, while in FIG. 6 it is depicted as being bent more strongly or substantially. To illustrate the situation clearly, the curvature of the roller 06 is greatly exaggerated in the drawings. In FIG. 5 a distance between the highest or most deformed point and the lowest or least deformed point of the barrel of the roller 06 is identified by "h". Thus, the value "h" represents a measure of the curvature "h" of the roller 06.

The direction of the curvature preferably extends close to, such as, for example +/−25°, and in particular +/−10° the direction of the bisecting line of the angle $\alpha$ wherein $\alpha$ is at least 45°, better yet is at least 90°, but preferably is between 95° and 115°.

Because of the curvature of the roller 06, the paper web 04 is bulged out, in the direction toward the center of the web 04, by the roller 06. In FIG. 5 a path length "l" from the roller 06 to the printing gap 03 results from this bulging out or deflection for center points of the paper web 04. This path length "l" is greater than the distance "a" from the roller 06 to the printing gap 03 which distance "a" must be traveled by points of the paper web 04 which are located at the edge of web 04. The closer a point is to the center of the paper web 04, the later it therefore arrives at the printing gap 03.

If, as represented in FIG. 6, the roller 06 is bent more, the curvature "h" is increased to "h'". For center points on the paper web 04, the path length "l" is also increased to the path length "l'". With the increased curvature "h'" of the roller 06, the center points therefore arrive even later in the printing gap 03 than do the points in the edge area of the paper web 04. By adjusting the curvature "h", "h'" of the roller 06 in this way, it is possible to determine how much later center points on the paper web 04 will arrive in the printing gap 03, in comparison with points that are located in the edge area of the paper web 04. Alternatively, in the running direction of the web 04 of material, the outermost points arrive at the printing gap 03 earlier than do the center points. This allows for the definite reduction of second or higher orders of terms of the register error.

In the same way, it is possible to set a displacement "h"/"h'" of the drive side, in the printing press center at a displacement 0, and, on the operating side of the press, a displacement "h"/"h'" in the opposite direction. In this way, the printed line can be configured as an S-line over the width of the printing press.

Figure 7:
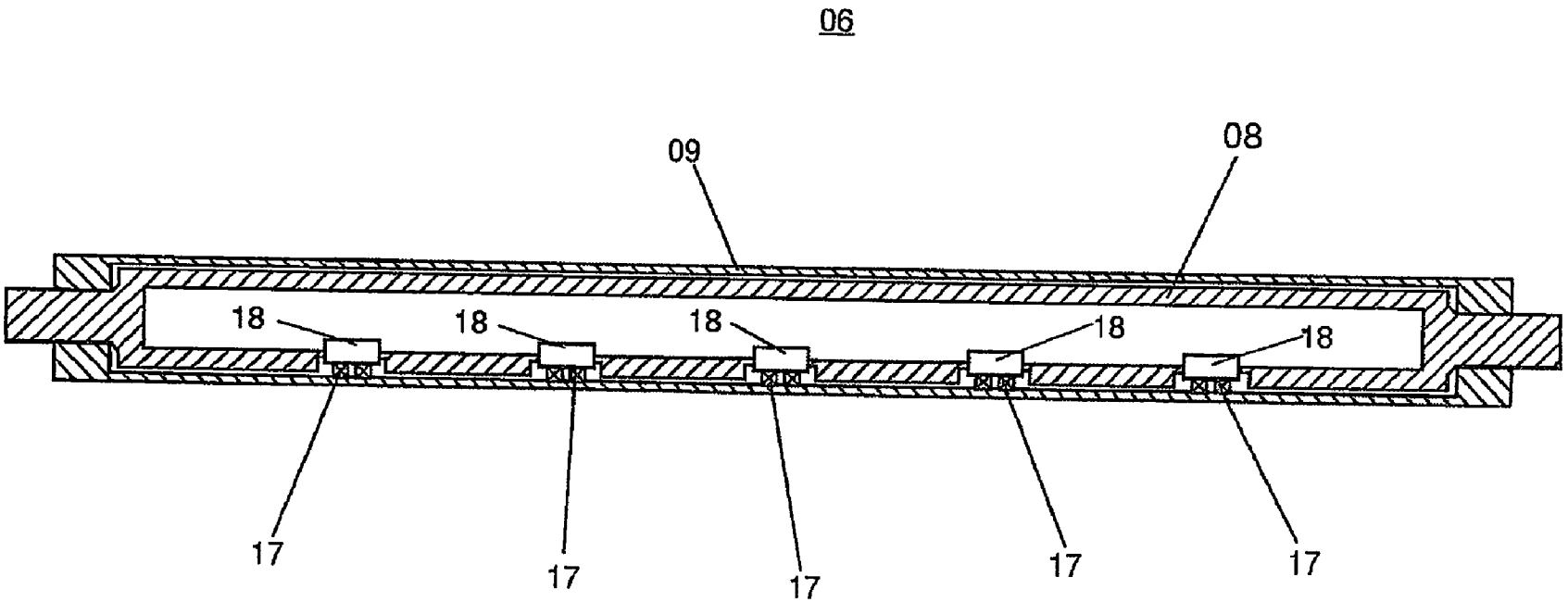

An alternative embodiment of the bendable or deformable roller 06 is represented in FIG. 7. This roller 06 also comprises a hollow shaft 08 and an elastic shell 09, which shell 09 can be rotated around this shaft 08. However, in this alternative embodiment, actuating members 18 are arranged on the shaft 08 inside the roller 06. The actuating members 18 include rolling bearings 17, through which members 18 push against the shell 09 from the inside and bend it in this way. In this case the rolling bearings 17 assure that the shell 09 can roll off the actuating members 18 as free of friction as possible.

In a further embodiment of the roller 06, which is represented in FIG. 7, second actuating members 18 are provided on the shaft 08 and are located in an arrangement which is not depicted, diametrically with respect to the represented actuating members 18. The actuating members 18 can be controlled either individually or in groups. It is thus possible, by the use of the group control of the actuating members 18, to bend the roller 06 into a roughly S-shaped form. Third actuating members 18 can also be provided on the shaft 08, in addition to, or alternately to the second actuating members 18, which act in a direction perpendicular to the action line of the represented actuating members 18, or in a direction which forms any arbitrary angle with the action line of the represented actuating members 18. A roller 06, which is embodied in such a way, can even be bent into any arbitrarily wound shape with respect to the longitudinal direction.

Figure 8:
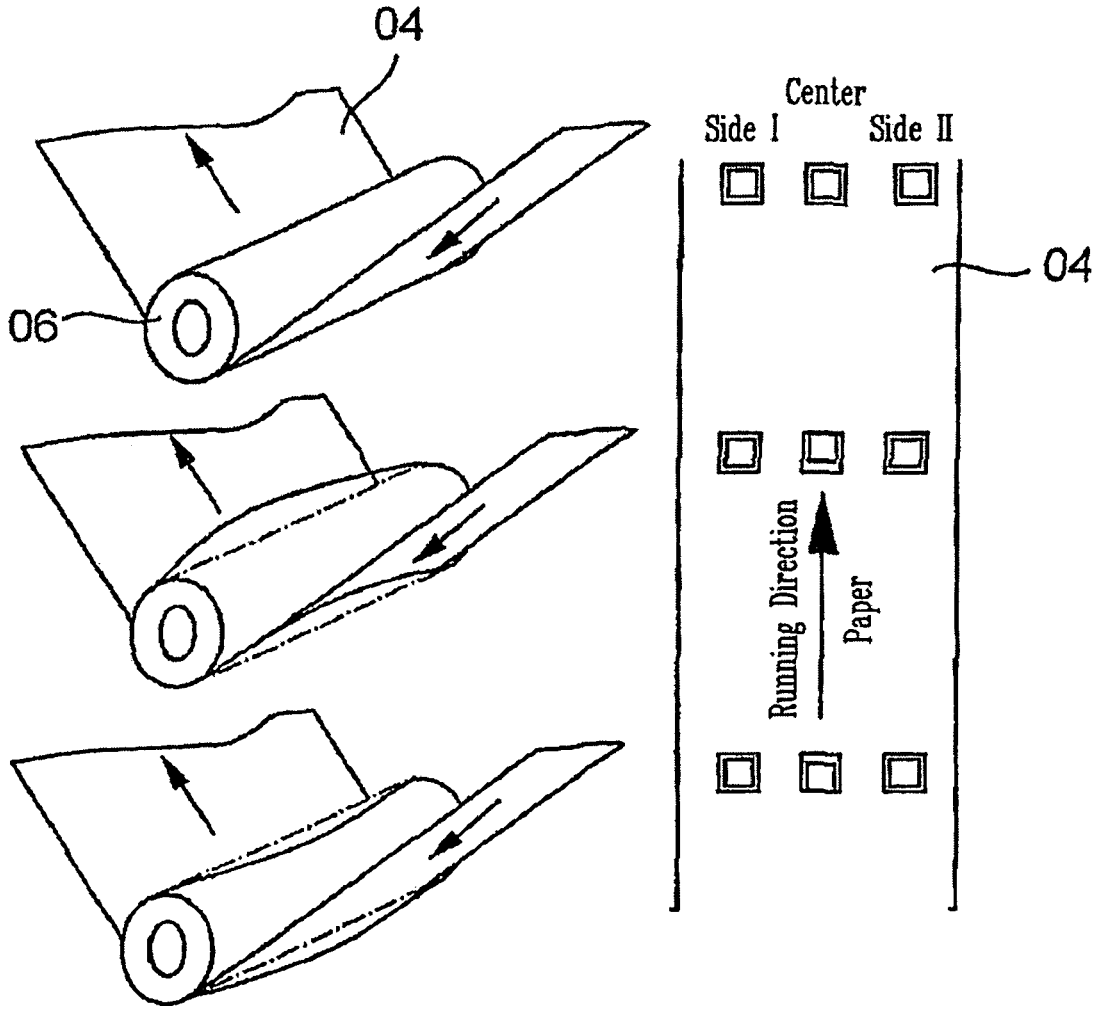

As is represented schematically in FIGS. 8 or 9, several image elements have been imprinted on a web 04 of material. Preferably, several first image elements have been imprinted side-by-side in a first printing group, and corresponding second image elements have been printed, also side-by-side in a second printing group. The schematically represented bendable or deformable roller 06, which, in particular, is a web guidance roller 06, belongs to the second printing group. By bending the roller 06, and in particular by bending roller 06 perpendicularly to the running direction of the web 04 of material, the image elements of the second printing group will be shifted opposite to, or in the running direction in relation to the image elements printed on the web 04 by the first printing group.

The position of the center image elements is changed in relation to the position of the two outer image elements as a function of bending of the roller 06. In another example, which is not specifically represented, the web 04 of material has at least four groups of image elements, each of which group of image elements is imprinted by a respective printing group. A bendable roller 06 is assigned to at least each of the last three of the at least four printing groups. The evaluation of this group of image elements can take place by the use of at least one sensor 13, 23, which sensor evaluates at least one image element of the at least four printing groups. Actuating elements for bending at least three rollers are operated as a function of the signal(s) of a sensor 13, 23, as discussed previously.

Figure 10:
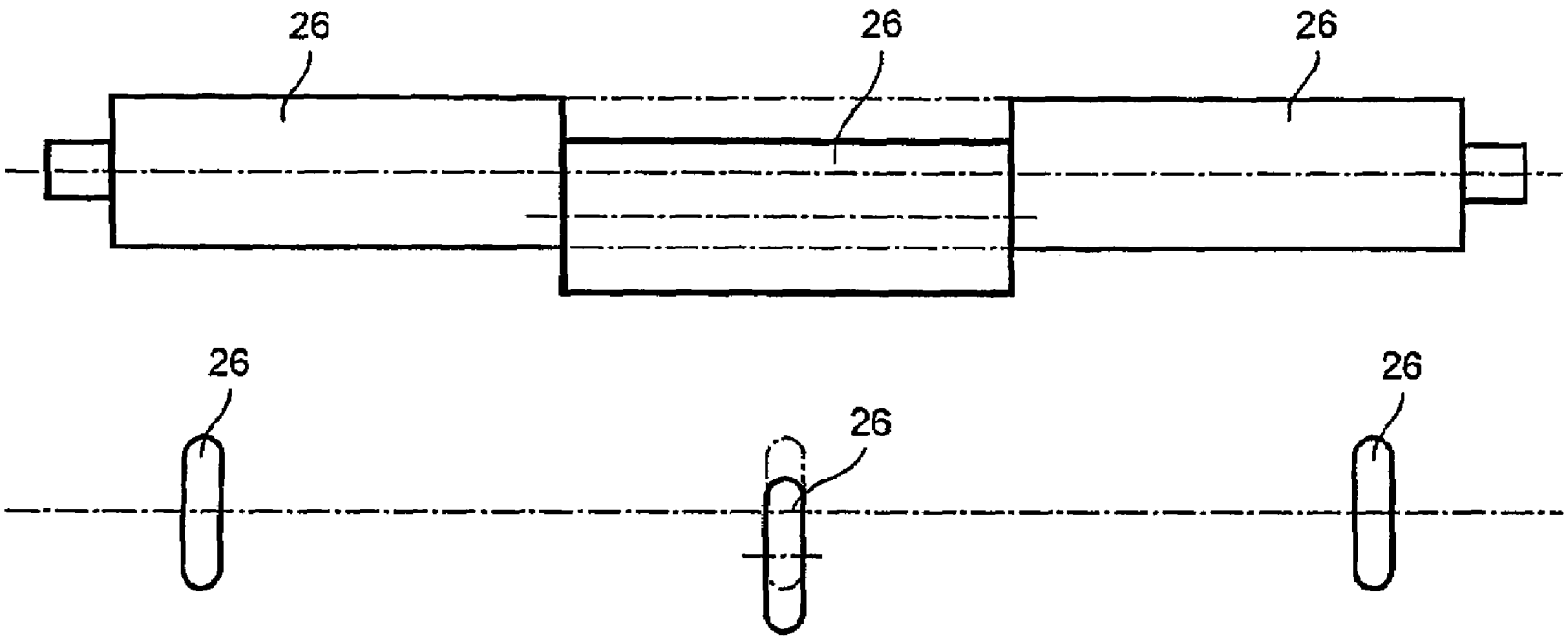

It is also possible to employ a roller with individual roller barrel sections 26, or with curved, such as, for example, with wheel-shaped, deformation elements 26, which can be adjusted in relation to each other, as seen in FIG. 10, in place of a continuous roller.

A contactless deformation of the web 04 of material is also possible, in particular by the use of compressed air, such as, for example, by adjusting the amount of air and/or the air pressure, or by changing the spacing of an air outlet opening.

The deformation of the web 04 of material at the deformation location, by the use of the bendable roller 06 or the deformation elements 26 takes place perpendicular to the running level of the web 04 of materials.

The roller 06 can be deformed in a direction which lies within a range of +/−25°, and in particular of +/−10°, in relation to a bisecting line of the wrap angle $\alpha$.

Preferably, the deformation of the web 04 of material by operation of the roller 06, or by use of the deformation elements 26, does not take place in any printing gap 03.

In addition to setting the register in the running direction of the web 04 of material, an adjustment of the registration transversely to the running direction, in response to for example, a temperature change, and in particular an increase in the temperature which causes shrinkage in a dryer between two printing gaps, and/or the introduction of moisture, such as, for example, saturated water vapor, for widening the web can take place. Preferably, a regulation or a setting of the register takes place first in the running direction, and then a regulation setting of the register takes place transversely to the running direction of the web.

While preferred embodiments of methods for reducing register errors on a web of material moving through the printing nip of a multi-color web fed rotary printing press and corresponding devices have been set forth fully and completely hereinabove, it will be apparent to one of skill in the art that various changes, for example, in the web of material to be printed, the structure of the forme cylinder and counter-pressure cylinder in each printing group, and the like could be made without departing from the true spirit and scope of the present invention which is accordingly to be limited only by the appended claims.

What is claimed is:

1. A multi-color web-fed rotary printing press comprising:

at least a first printing group and at least one second printing groups, each of said printing groups defining a printing gap and arranged to print at least first and second colors on a web passing through said at least first printing group and said at least one second printing group;

at least one bendable roller positioned at an inlet to at least one of said at least first and second printing groups, said at least one bendable roller being looped by said web;

at least one sensor adapted to detect a register error on said web and located after, in a running direction of said web, said first printing group; and at least one actuating member usable to set a curvature of said at least one bendable roller selectively in, and opposite to said running direction of said web and wherein said curvature of said at least one bendable roller is set in response to said register error detected by said at least one sensor in said at least first and second colors printed on said web, in said running direction of said web.

2. The printing press of claim 1 wherein said bendable roller includes deformable elements and further wherein said at least one actuating member is adapted to set a position of said deformable elements to set said curvature of said at least one bendable roller in response to said detected register error.

3. The printing press of claim 1 further including first and second adjusting elements acting on end areas of said at least one bendable roller.

4. The printing press of claim 1 wherein at least one end of said at least one bendable roller and another area of said roller are deformable relative to each other.

5. The printing press of claim 4 further wherein a second end of said roller and said first end of said roller and said other area are deformable relative to each other.

6. The printing press of claim 1 wherein said at least one bendable roller has one of a concave and a convex shape.

7. The printing press of claim 1 wherein said at least one bendable roller has an S-shape.

8. The printing press of claim 1 further including a sensor and an evaluation unit connected to said sensor and with said actuating member and adapted to change a curvature of said bendable roller as a function of said detected register error.

9. The printing press of claim 1 wherein said at least one bendable roller includes a central shaft and a shell supported for rotation on said shaft.

10. The printing press of claim 9 further including a frame supporting ends of said shaft and further wherein said actuating member is supported at a first end on said frame and at a second end in engagement with said shaft.

11. The printing press of claim 9 wherein said actuating member is in said roller between said shaft and said shell and acts between said shaft and said shell.

12. The printing press of claim 1 wherein said at least one bendable roller includes first and second ends which are adjustable independently of each other.

13. The printing press of claim 1 further including at least one eccentric device adapted to adjust said curvature of said roller.

14. The printing press of claim 1 further including at least one eccentric bushing supporting at least one end of said bendable roller.

15. The printing press of claim 1 further including a deflection roller positioned before, in said running direction of said web, said at least one bendable roller, said deflection roller being shiftable for setting said looping of said material on said at least one bendable roller.

16. The printing press of claim 1 wherein said at least one sensor is adapted to detect said register error in a center area of said web.

17. The printing press of claim 1 wherein said at least one sensor is adapted to detect said register error in an edge area of said web.

18. The printing press of claim 1 wherein said printing press is a rotary rotogravure printing press.

19. The printing press of claim 1 wherein said at least one bendable roller is looped by said web over at least 45° in a circumferential direction of said roller.

20. The printing press of claim 1 wherein said at least one bendable roller is looped by said web over at least 90° in a circumferential direction of said roller.

21. The printing press of claim 1 wherein said at least one bendable roller is looped by said web over between 95° and 115° in a circumferential direction of said roller.

* * * * *